US006330924B1

(12) United States Patent
Hall

(10) Patent No.: US 6,330,924 B1
(45) Date of Patent: Dec. 18, 2001

(54) SUPERHARD DRILL BIT HEEL, GAGE, AND CUTTING ELEMENTS WITH REINFORCED PERIPHERY

(76) Inventor: David R. Hall, 2185 S. Larson Pkwy., Provo, UT (US) 84606

( * ) Notice: Subject to any disclaimer, the term of this patent is extended or adjusted under 35 U.S.C. 154(b) by 0 days.

(21) Appl. No.: 09/537,551

(22) Filed: Mar. 30, 2000

Related U.S. Application Data

(63) Continuation-in-part of application No. 08/664,527, filed on Sep. 25, 1996, now abandoned.

(51) Int. Cl.[7] ..... E21B 10/36
(52) U.S. Cl. ..... 175/430; 175/431; 175/432
(58) Field of Search ..... 175/425, 426, 175/428, 430–432

(56) References Cited

U.S. PATENT DOCUMENTS 5,492,188 * 2/1996 Smith et al. .
5,928,071 * 7/1999 Devlin .
5,957,228 * 9/1999 Yorston et al. .

* cited by examiner

*Primary Examiner*—Roger Schoeppel

(57) ABSTRACT

A planar or convex heel, gage, or cutting element comprising one or more layers of superhard materials bonded to a metal-carbide substrate. The substrate's perimeter is inclined and comprises one or more circumscribing grooves or furrows, or flutes, in order to permit the bonding of superhard materials below the plane of the major interface, thereby reinforcing the perimeter of the element itself. This heel, gage, or cutting element is useful in drilling applications for the oil, gas, geothermal, and mining industries.

8 Claims, 8 Drawing Sheets

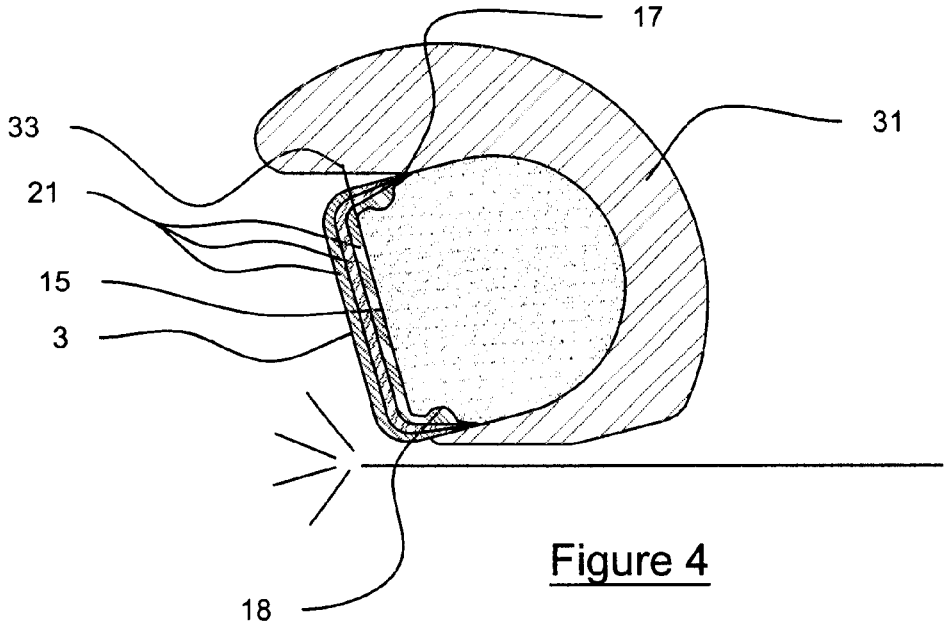
Figure 4
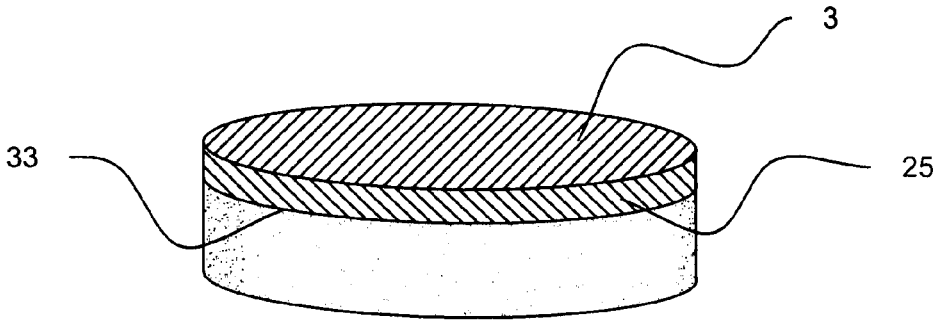
(Prior Art) Figure 5
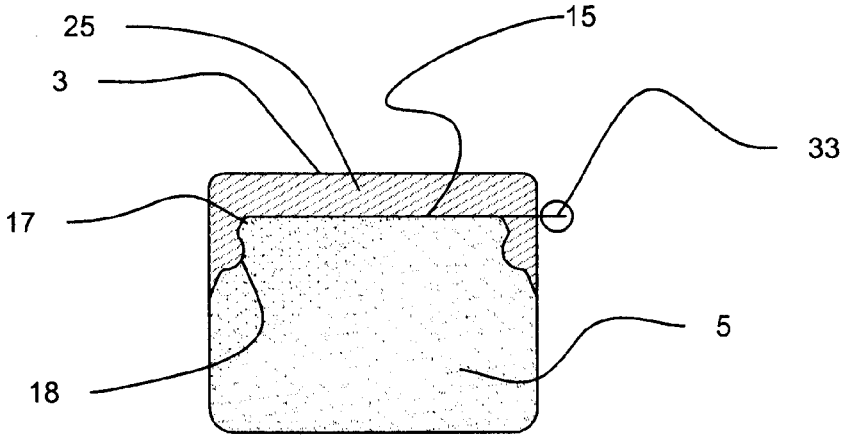
Figure 6

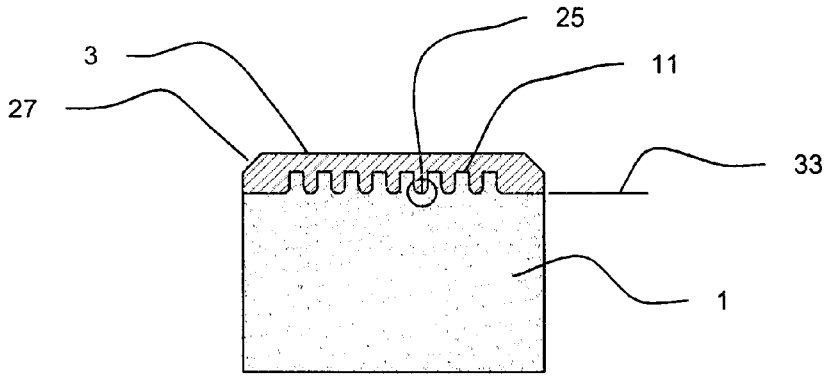
Figure 10
Prior Art
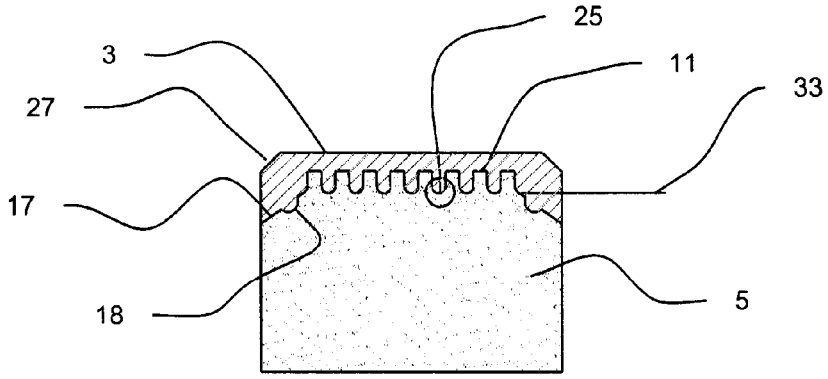
Figure 11
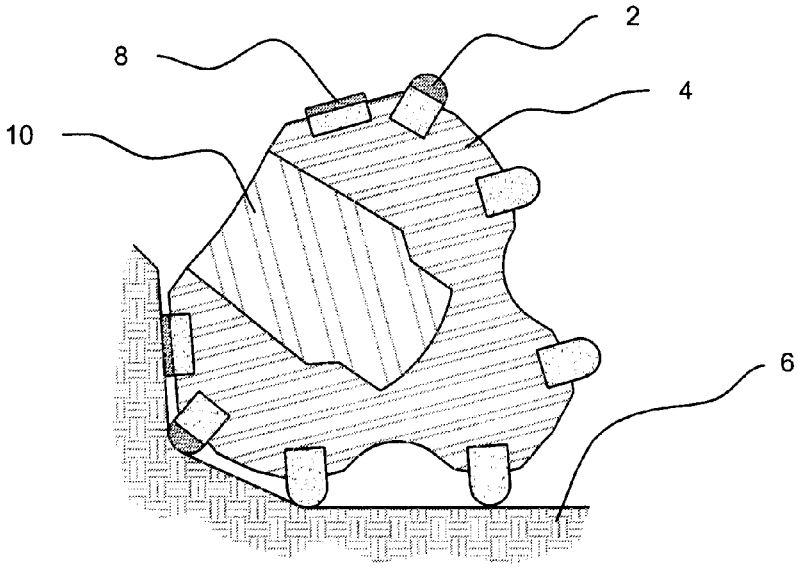
(Prior Art) Figure 12

SUPERHARD DRILL BIT HEEL, GAGE, AND CUTTING ELEMENTS WITH REINFORCED PERIPHERY

RELATED APPLICATIONS

Continuation-In-Part of application Ser. No. 08/664,527 filed on Sep. 25, 1996, now abandoned.

FIELD OF INVENTION

This invention relates to superhard planar and/or convex drill bit elements useful in rotary and rolling-cone, earth-boring, bits for heel, gage, and cutting inserts for the oil, gas, geothermal, and mining industries. The heel, gage, and cutting inserts comprise a cylindrical metal-carbide substrate, or stud, onto which one or more layers of superhard material are bonded using a high-pressure/high temperature press apparatus. The substrate's perimeter is inclined, with one or more inclinations and circumscribed by one or more furrows or grooves, or is fluted, so as to permit the bonding of one or more layers of superhard material below the plane of the major interfacing surfaces, thereby reinforcing the perimeter, or cutting edge, of the element itself As used in this patent: "superhard" or "superhard material" refers, without limitation, to one or more layers of natural or synthetic diamond, polycrystalline diamond, cubic boron nitride, diamond films, or thermally stable products. "Cylindrical" includes, without limitation, having a square, hexagonal, rectangular, diamond, conical, or hemispherical cross section shape. "Inclined" or "Inclinations" means chamfered, curved, rounded, fluted, radiused, tapered, or beveled, by means of grinding, cutting, shaping, preforming, or any other means known in the art. The "Plane of the Interface" refers to a line that is perpendicular to the major sides of the cutting element and defined by the bonded, adjacent surfaces of the superhard material and the substrate. "Substrate" means a cylindrical metal-carbide stud or post onto which the superhard material is bonded. "Non-Planar" means an interrupted surface comprising a pattern or profile of one or more grooves, ridges, furrows, shapes, or designs. "Heel insert or element" refers to a superhard insert positioned in the circumferential heel row of a rolling cone, or rotary cone, earth-boring bit. "Gage insert or element" refers to a superhard insert positioned in the gage row of either a rotary bit, which includes drag and shear bits, or a rolling cone, or rotary cone, earth boring bit so as to define and maintain the inside diameter, or gage, of the well bore as the bit drills the formation. "Cutting insert or element" refers to a superhard insert positioned on rotary and rolling cone, or rotary cone, earth boring bits so as to penetrate the formation being drilled as the bit rotates by means of cutting, abrading, and/or impacting the subsurface.

DESCRIPTION OF RELATED ART

Superhard cutting elements have been used in drill bits for the oil, gas, geothermal, and mining industries for more than a two decades. Superhard heel and gage elements have been used in drill bits for a much shorter time, but their use is known in the art today. Numerous means have been employed to strengthen the superhard surface of these elements to make them more resistant to premature failure usually manifested by edge chipping and delamination. The following prior art references not only teach the inventive techniques employed to toughen superhard elements, they also disclose the breath of the prior art pertaining to the present invention. It will be noted in the following prior art references that, unlike the elements in the present invention, the elements' superhard surfaces do not exhibit one or more inclinations having one or more circumscribing furrows or grooves, or flutes, along the surface that extends below the plane of their major interfacing surface between the superhard material and the substrate.

U.S. Pat. No. 5,172,778. This patent exhibits a superhard cutter with a serrated working surface intended to aid in chip removal and cooling of the superhard cutter's working face during cutting.

U.S. Pat. No. 5,238,074. This patent displays a cutter having a non-uniform working face of varying thickness and hardness so that the cutting edge has a wear ratio which varies with wear. The premise of this design was that it was desirable to have a cutter whose surface wore away at different rates during drilling. Thus, it was postulated, the wear rate would vary in a pre-selected fashion to optimize cutting through formations of varying hardness.

U.S. Pat. No. 5,351,772. The radial land configuration of this cutter's substrate on the interfacing surface with the superhard material was believed to redistribute the stresses along the interface, reduce their areas of concentration, and essentially interrupt the stress fields across the working surface of the cutter, thereby reducing the likelihood of edge fracturing and the propagation of fractures across the entire face of the cutter. It was also thought that the lands permitted the use of a thicker diamond table which would also reduce the risk of spalling and fracture. Despite the interrupted periphery of the substrate, the superhard material does not extend below the plane of the interface as defined in this disclosure.

U.S. Pat. No. 5,355,696. The innovations of this patent focus on its attempt to add support to the bond between the substrate and the superhard material surface by installing radially spaced-apart alternating channels and ridges. It was believed that such a configuration would strengthen the bond and consequently improve fracture and delamination resistance.

U.S. Pat. No. 5,373,908. This patent attempts to teach that by splitting the cutter and fashioning a chamfer along the split edge adjacent to the substrate and in a matching groove in the substrate itself, the stress concentrations along the face of the cutter will be reduced.

U.S. Pat. No. 5,435,403. This patent postulates that by thickening the diamond table of the cutter where it actually contacts the formation being drilled, and by having a multi-thickness diamond table, the cutter will produce a kerfing action during drilling as the thinner portions wear less than the thicker ones. Also, the thicker portions of the cutter were thought to stiffen the cutter so as to resist its tendency to flex upon initial contact with the formation. Such flex is thought to contribute significantly to fracture failure of the superhard material.

U.S. Pat. No. 5,120,327. In this patent the interfacing surfaces comprise a plurality of spaced apart ridges forming grooves there between. The ridges are spaced radially inwardly from an outer periphery of the substrate, whereby the diamond layer includes an annular ring portion completely surrounding the plurality of ridges to provide radial reinforcement against the formation and propagation of cracks tending to occur in the vicinity of the ridges. Despite the presence of two interfacing planes, it will be noted in this design that the diamond table does not extend below the plane lowest plane.

U.S. Pat. No. 5,437,343. In this example, the periphery of the superhard cutter's planar working surface is ground with a double chamfer, at different acute angles, in an effort to create a bearing surface which supports the cutter against the formation being drilled. This additional support is believed to aid in reducing edge fracture during the early stages of drilling when the edges of the cutters are most exposed to lateral stress and chipping. Even though the superhard cutting table has an inclined edge, the substrate's interfacing periphery has retained its right angle profile, and the diamond table does not extend below the substrate's interfacing surface.

U.S. Pat. No. 5,346,026. This disclosure teaches the use of gage inserts to maintain the gage of the bore hole using a rolling cone earth-boring bit.

U.S. Pat. No. 5,351,770. In this patent the use of superhard inserts in the heel row of a rotary cone bit is disclosed. The inserts are positioned in the circumferential heel row of the bit and serve to maintain the gage, or inside diameter, of the bore hole.

U.S. Pat. No. 5,467,836. Finally, in this patent's specification the use of superhard gage inserts in a rotary, or shear or drag, bit is disclosed. In this application, the inserts are interference fitted into sockets in the bit's surface proximate to the side wall of the bore hole. Again, these inserts serve to maintain the gage, or inside diameter, of the bore hole as the bit drills the subterranean formation.

Those skilled in the art are also directed to U.S. Pat. Nos. 5,486,137, 5,494,477, 5,605,199, 5,566,779, 5,351,772, and 5,887,580, incorporated herein by this reference, as additional examples of efforts to strengthen the cutting edge of superhard cutting elements.

SUMMARY OF INVENTION

This invention discloses heel, gage, and cutting inserts with a planar or convex superhard surface having a reinforced periphery useful in rolling cone, or rotary cone, and rotary drill bits, also known as shear or drag bits, for drilling in the oil, gas, geothermal, and mining industries. The reinforced perimeter of these elements is achieved by inclining the perimeter of the metal-carbide substrates and by adding one or more circumscribing furrows or grooves, or by adding flutes, along the inclined edge below the plane of their major interfacial surfaces, and by high pressure/high temperature bonding of the superhard material across this inclined edge, or edges, so as to give sub-lateral support to the perimeter of the elements themselves. Tests have shown that this design improves the elements' resistance to edge chipping and delamination, the two most frequent forms of premature failure in these superhard inserts.

BRIEF DESCRIPTION OF DRAWINGS

FIG. 4 is a cross-sectional representation of a preferred embodiment of the present invention's rotary cutting element mounted in a bit matrix as though drilling a subterranean formation. This view depicts one or more superhard material layers bonded to a substrate having the groove and an inclined periphery of FIG. 3, together with a domed or hemispherical shaped base for stress relief.

FIG. 5 is a perspective view of a heel, gage, or cutting element useful in rolling cone and rotary bits, also known as shear or drag bits. The element comprises a metal-carbide substrate onto which superhard material is bonded FIG. 6 is a cross-sectional representation of a preferred embodiment of the present invention that is similar to the view displayed in FIG. 2. This view depicts a single furrow located in the inclined periphery of the substrate.

FIG. 10 is a cross-sectional representation of a prior art cutting element having a non-planar interface defined by ridges or grooves, either in a circular or parallel pattern across the surface of the substrate. The layer of superhard material does not extend below the major plane of the interface.

FIG. 11 is a cross-sectional representation of a preferred embodiment of the present invention having the non-planar interface of FIG. 10 defined by ridges or grooves, either in a circular or parallel pattern across the surface of the substrate. The superhard material is extended below the plane of the major interface along the inclined periphery, which exhibits a groove or furrow in order to reinforce the periphery of the cutting element.

FIG. 12 is a cross-sectional illustration of a rolling cone, or rotary cone, typically used in a rolling cone bit.

DETAILED DESCRIPTION OF INVENTION

Figure 1:
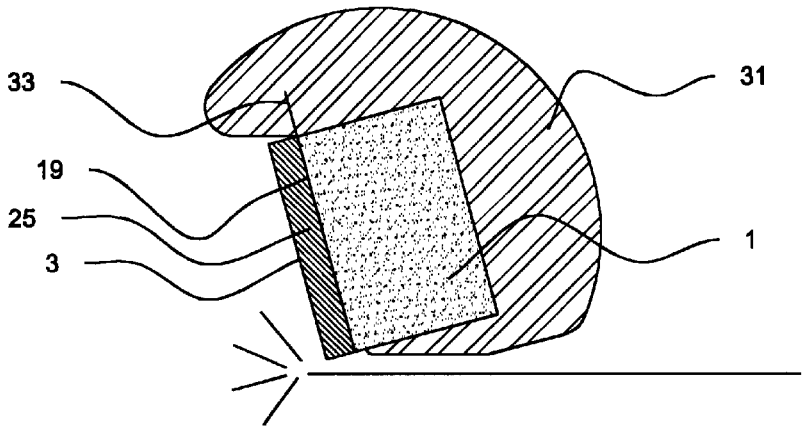
Figure 1 Prior Art
FIG. 1 is a cross-sectional representation of a prior art rotary-bit cutting element mounted in a bit matrix and depicted as though drilling a subterranean formation. This view depicts how in the prior art the superhard material does not extend below the plane of the major interface between the superhard material and the substrate.

The purpose of this invention was to find an improved means of strengthening the superhard cutting edge and surface of rolling cone and rotary bit heel, gage, and cutting elements. The primary difference between heel, gage, and cutting elements is their relative location on the bit. The heel element is located in the circumferential heel row rolling cone, or rotary cone, bits. The gage element is located on a rolling cone and rotary bit, also known as shear or drag bit in order to define and maintain the inside diameter of the well bore. The cutting element is positioned so that it cuts away the subterranean formation being drilled, either by percussion, abrasion, or cutting. It is known in the art that the element's resistance to edge chipping and delamination may be improved by inclining the edge of the element's superhard surface as taught in the prior art references cited herein. What the applicant was surprised to learn was that by inclining the edge of the substrate, with one or more inclinations and by circumscribing the inclined edge with one or more furrows or grooves, or by adding flutes, below the plane of the major interfacial surfaces, and bonding the superhard material below the plane of the major interfacial surfaces, even greater improvement was achieved in the element's resistance to edge chipping and delamination. It appears that this configuration adds sub-lateral support to strengthen the edge of the element. As pointed out in the prior art references, numerous attempts have been made to strengthen the superhard table, but none of those attempts have included, nor even intimated, that improved resistance to edge chipping and delamination could be obtained by adding one or more inclinations with circumscribing grooves, or by adding flutes, below the plane of the major interfacing surfaces. It is also the function of this application to teach that the exact profile of the inclined edge may vary depending upon the intended application of the heel, gage, or cutting element. But regardless of the precise application, tests have confirmed that by inclining the perimeter of the substrate's interface, and adding one or more inclinations that are circumscribed by one or more furrows or grooves, or by adding flutes, and bonding superhard materials by high-pressure and high-temperature below the major interfacial plane, along the inclined edge, the element exhibits improved resistance to edge chipping and delamination.

A detailed description of the present invention will be best understood in reference to the foregoing drawings. It will be noted that the drawings are not to scale in order to illustrate more clearly the characteristics of the present invention. Also, those familiar with the art will appreciate that the representative illustrations presented in this application, while descriptive of the characteristics of the invention, do not depict every possible configuration predicted by, or in the spirit of, this invention. Nevertheless, it is the intention of the applicant to claim all aspects of this invention, whether or not specifically depicted.

FIG. 1. This is a cross-sectional view of a prior art rotary-bit cutting element depicted as though installed in a bit matrix 31 and drilling a formation. The superhard material layer 25 is bonded to a metal-carbide substrate 1 by a high pressure/high temperature process known in the art. The substrate 1 has a planar or non-planar major interfacing surface 19. The outer surface of the material 3 may exhibit a variety of profiles including planar and convex. The superhard material layer 25 does not extend below the plane of the major interface 33 with the metal-carbide substrate 1. Although various means have been employed to strengthen the prior art element, as outlined in the prior art references cited in this application, those means have not included extending the diamond table below the plane of the substrate's interface as in the present invention. These prior art configurations all lack the perimeter sub-lateral support of the present invention and are more susceptible to edge chipping and delamination than the present invention.

Figure 2:
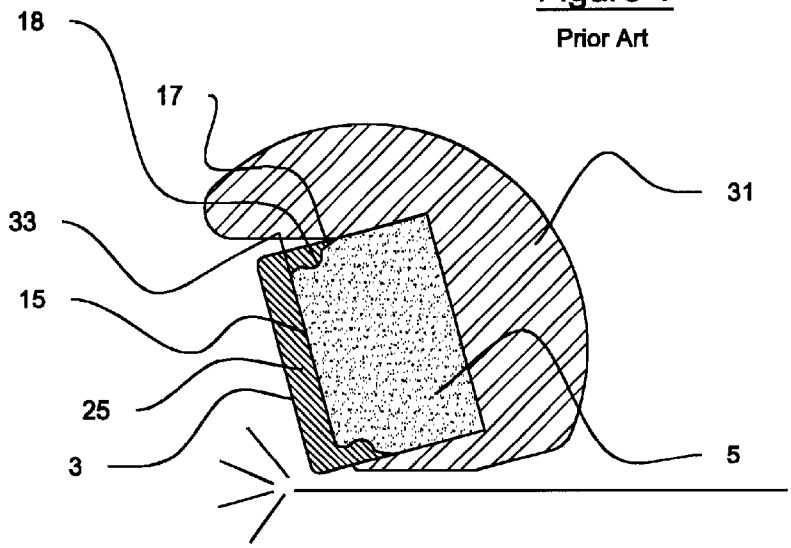
FIG. 2 is a cross-sectional representation of a preferred embodiment of the present invention's rotary cutting element mounted in a bit matrix as though drilling a subterranean formation. This view depicts how in the present invention the substrate's inclined perimeter is circumscribed with a groove, and the superhard material is extended below the plane of the major interface.

FIG. 2. This is a cross-sectional view of a preferred embodiment of the present invention's cutting element displayed in a bit matrix 31 as though drilling a formation. The illustration depicts a planar, single layer of superhard material 25 bonded to a metal-carbide substrate 5, using a high pressure/high temperature sintering press apparatus known in the art. The substrate 5 has an inclined perimeter 17 across which the superhard material 25 is bonded. The substrate's inclined edge 17 may exhibits a furrow or groove 18 and may also exhibit one or more inclinations as defined in the application. The substrate 5 may have a planar or non-planar major interfacing surface 15 with the superhard material 25 extending beyond the plane of the major interface 33. The superhard material 25 bonded to the inclined periphery 17 of the substrate 5 adds sub-lateral support to the cutting edge of the element, thereby making it more resistant to edge chipping and delamination.

Figure 3:
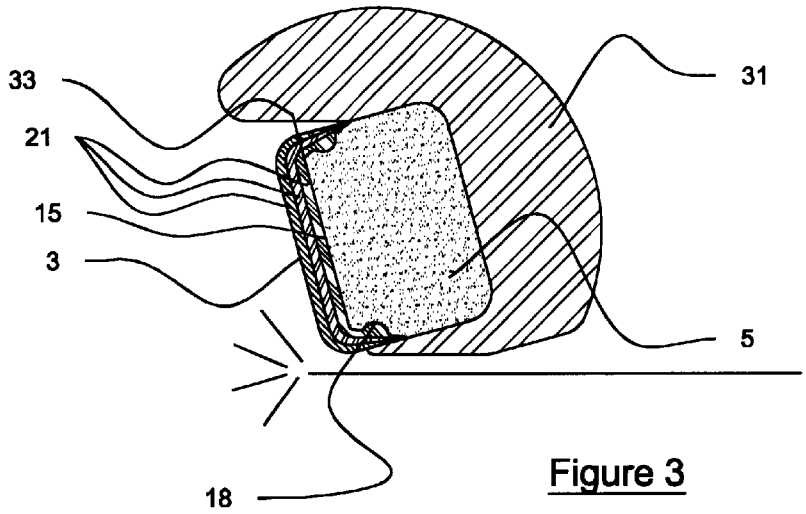
FIG. 3 is a cross-sectional representation of a preferred embodiment of the present invention's rotary cutting element mounted in a bit matrix as though drilling a subterranean formation. This view depicts a plurality of superhard material layers bonded to a substrate having the groove and inclined periphery of FIG. 2.

FIG. 3. This is a cross-sectional view of a preferred embodiment of the present invention's cutting element displayed in a bit matrix 31 as though drilling a formation. The illustration depicts a plurality of superhard material layers 21 bonded to a metal-carbide substrate 5, using a high pressure/high temperature sintering press apparatus known in the art. The substrate 5 has an inclined perimeter 17 exhibiting a furrow or groove 18 across which the superhard materials 21 are bonded. The outer most surface of the cutting table 3 may exhibit a variety of profiles including planar or convex. The substrate's inclined edge 17 may exhibit one or more inclinations as defined in this application. The substrate 5 may have a planar or non-planar major interfacing surface 15 with the superhard materials 21 extending beyond the plane of the interface 33. The superhard materials 21 bonded to the inclined periphery 17 of the substrate 5 add sub-lateral support to the cutting edge of the heel, gage, or cutting element, thereby making it more resistant to edge chipping and delamination.

FIG. 4. This is a cross-sectional view of a preferred embodiment of the present invention's cutting element displayed in a bit matrix 31 as though drilling a formation. The illustration depicts one or more superhard material layers 21 bonded to a metal-carbide substrate 5 having a convex or hemispherical base to reduce stress, using a high pressure/high temperature sintering press apparatus known in the art. The substrate 5 has an inclined perimeter 17 exhibiting a furrow or groove 18 across which the superhard materials 21 are bonded. The outermost surface of the element's superhard table 3 may exhibit a variety of profiles including planar and convex. The substrate's inclined edge 17 may exhibit one or more inclinations as defined in this application. The substrate 5 may have a planar or non-planar major interfacing surface 15 with the superhard materials 21 extending beyond the plane of the interface 33. The superhard materials 21 bonded to the inclined periphery 17 of the substrate 5 add sub-lateral support to the cutting edge of the element, thereby making it more resistant to edge chipping and delamination.

FIG. 5. Here is depicted a perspective view of a heel, gage, or cutting element of the present invention. The element comprises a metal-carbide substrate 1 onto which one or more layers of superhard material 25 are bonded by a high temperature/high pressure sintering process known in the art. The superhard material extends below the plane of the major interface 33. The working surface 3 may exhibit a planar or convex profile.

FIG. 6. Here is depicted a cross-sectional representation of the preferred embodiment of the present invention. The outer most surface 3 of this heel, heel, gage, or cutting element may exhibit a variety of profiles including planar and convex. The substrate's major interface 15 may also present a variety of profiles. The superhard material 25 is bonded by a high-pressure high-temperature sintering process across the major interface 15 and down the inclined periphery 17, and the inclined periphery 17 exhibits a circumscribing furrow or groove 18 giving the edge of superhard cutting table sub-lateral support. Additional furrows, not depicted, may be installed in the inclined perimeter for added support.

Figure 7:
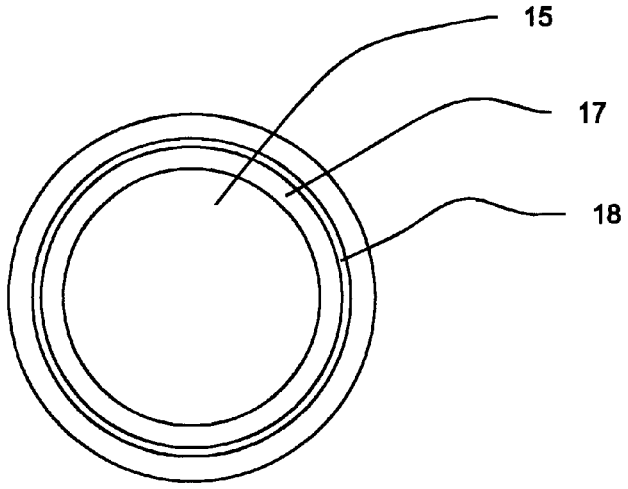
FIG. 7 is an aerial view representation the groove along the inclined perimeter of the present invention that as depicted in FIG. 6.

FIG. 7. This is an aerial view of the substrate of FIG. 6 showing the planar or convex major interfacial surface 15, the inclined edge 17, and a circumscribing furrow 18. It is contemplated that additional furrows may be installed around the circumference of the inclined edge to give additional support to the edge of the superhard surface.

Figure 8:
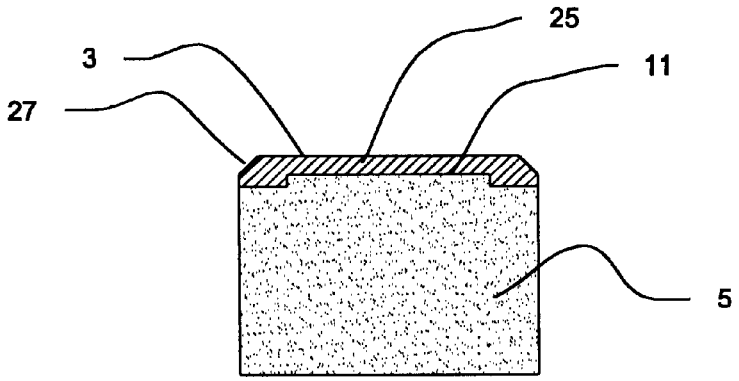
Figure 8 Prior Art
FIG. 8 is a cross-sectional representation of a prior art cutting element having a non-planar major interface between the substrate and the superhard material. The layer of superhard material does not extend below the plane of the major interface and the periphery of the substrate is not inclined.

FIG. 8. This is a cross-sectional representation of a prior art cutting element. This element exhibits a metal carbide substrate 5 with a non-planar major interface 11, comprising a single groove or ridge, displayed in radial or parallel pattern, and a single layer of superhard material 25 with an inclined edge 27.

Figure 9:
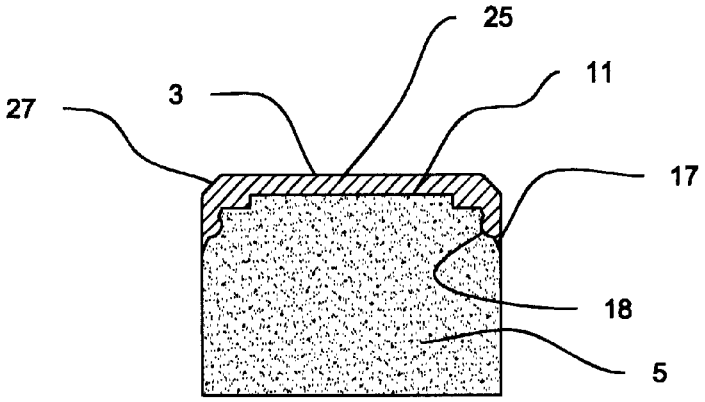
FIG. 9 is a cross-sectional representation of a preferred embodiment of the present invention exhibiting a profile having a non-planar major interface between the substrate and the superhard material. The layer of superhard material extends below the plane of the interface and the periphery of the substrate exhibits a groove and is inclined.

FIG. 9. Here is a cross-sectional representation of the prior art FIG. 8 in a preferred embodiment of the present invention. This heel, gage, or cutting element has a metal carbide substrate 5 with a non-planar major interface 11 comprising a single groove or ridge displayed in a radial or parallel pattern onto which the superhard material 25 is bonded. The face of the element 3 may be either planar or convex with an inclined edge 27. The substrate 5 has an inclined periphery 17 comprising a furrow or groove, and the superhard material 23 is bonded to the inclined periphery 17, in order to give the periphery of the cutting element sub-lateral support.

FIG. 10. Depicted here is a cross-sectional view of a prior art heel, gage, or cutting element having a metal-carbide substrate 1 with a non-planar major interface 11 comprising a plurality of spaced apart ridges or grooves displayed in a radial or parallel pattern onto which the superhard material 25 is bonded. The face of the element 3 may exhibit a planar or convex surface with an inclined edge 27. The superhard material does not extend below the plane of the interface 33.

FIG. 11. Depicted here is the cutting element of FIG. 10 in a preferred embodiment of the present invention's heel, gage, or cutting element shown in cross-sectional representation. The metal-carbide substrate 5 has a non-planar interface 11 comprising a plurality of spaced apart ridges or grooves displayed in a radial or parallel pattern onto which the superhard material 25 is bonded. The cutting face of the element 3 may exhibit a planar or convex profile with an inclined edge 27. The superhard material 25 is bonded to the major non-planar interfacial surface 11 by means of a high-pressure high-temperature sintering process known in the art and down the inclined edge which comprises a circumscribing furrow or groove 18, giving the periphery of the cutting element additional sub-lateral support.

FIG. 12. This is a cross sectional representation of a roller cone 10, comprising cutting elements 8 and 2 of the present invention installed into the bit matrix 4 as it cuts through a formation 6.

Figure 13:
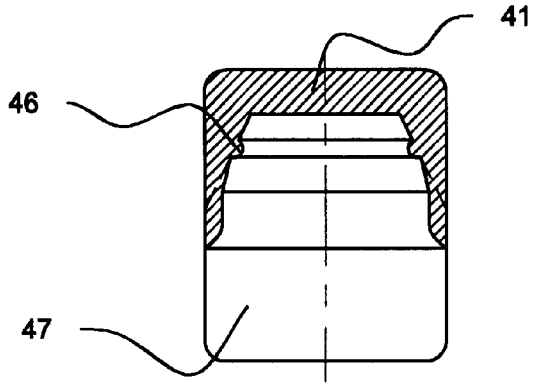
FIG. 13 is a cross-sectional view of the present invention depicting a substrate having a circumscribing groove or furrow along an inclined edge together with one or more additional inclinations.

FIG. 13. This is a cutting element of the present invention comprising a superhard material 41 bonded to a substrate 47 by means of a high-pressure high-temperature sintering process known in the art. The substrate exhibits a circumscribing groove 46 along the inclined periphery of the substrate, which also exhibits one or more inclinations. This configuration of the present invention provides sub-lateral support to the edge and flank of the cutting element as well as providing greater surface area upon which to bond superhard material.

Figure 14:
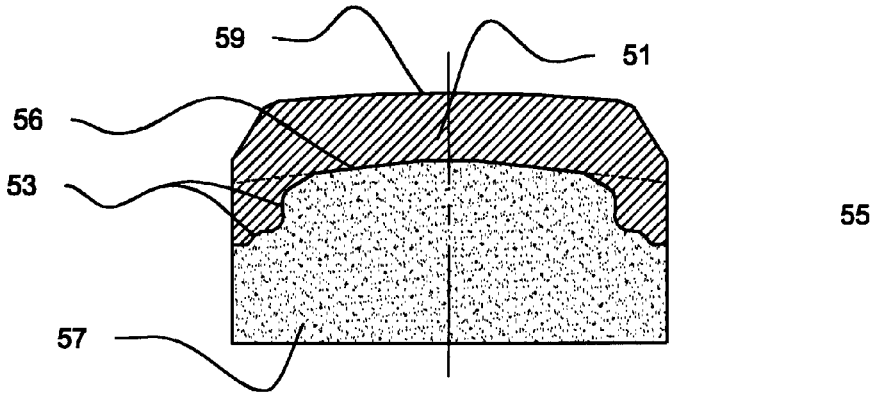
FIG. 14 is a cross-sectional view of the present invention depicting a substrate having a convex major interface, an inclined periphery comprising one or more inclinations, and a circumscribing groove or furrow.

FIG. 14. This is another embodiment of the present invention depicted in cross section representation. The cutting element comprises a superhard material 51 having a convex cutting surface 59 bonded by high-pressure high-temperature sintering process known in the art to a metal carbide substrate 57. The substrate comprises a convex major interfacial surface 56 and an inclined perimeter. The inclined perimeter features one or more inclinations 53 and a circumscribing groove 55. This configuration of the present invention provides sub-lateral support for the cutting edge and flank of the cutting element and allows for the bonding of superhard material below the major interfacial surface.

Figure 15:
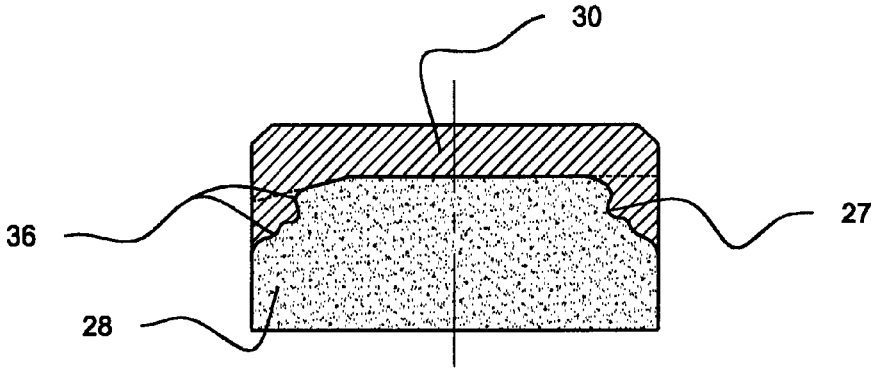
FIG. 15 is a cross-sectional view of the present invention depicting a substrate having a complex major interface comprising a planar portion and an inclined portion, as well as an inclined perimeter having a circumscribing groove or furrow and one or more inclinations.

FIG. 15. This embodiment of the present invention comprises a superhard cutting table 30 bonded by high-pressure high-temperature to the substrate 28. The substrate has an inclined edge consisting of one or more inclinations 36 and a circumscribing groove 27.

Figure 16:
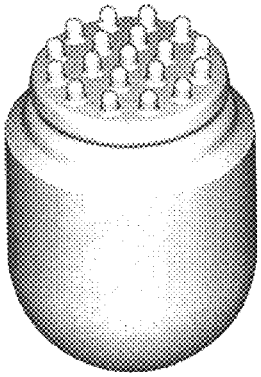
FIG. 16 is a perspective view of a substrate of the present invention.

FIG. 16. This is a perspective view of a substrate comprising the present invention.

Figure 17:
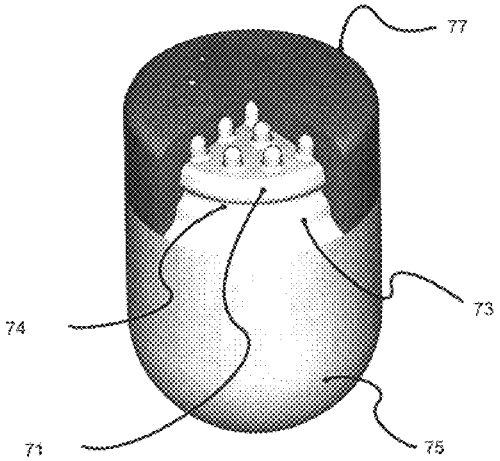
FIG. 17 is a cut away perspective view of a cutting element of the present invention.

FIG. 17. This is a cut-away perspective view of the present invention depicting the substrate 75 having a circumscribing groove 74 and one or more inclinations 71 and 73 that make up the inclined edge of the substrate. The substrate is bonded to a layer of superhard material 77 by means of a high-pressure high-temperature sintering process known in the art. The complex inclined edge of this embodiment of the present invention provides support for the cutting edge of the element and allows for bonding of a thick layer of superhard material along the flank of the cutting element.

Figure 18:
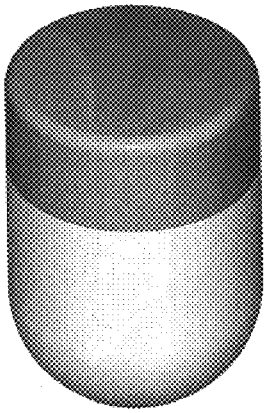
FIG. 18 is a perspective view of a cutting element of the present invention.

FIG. 18. This is a perspective view of a cutting element of the present invention.

Figure 19:
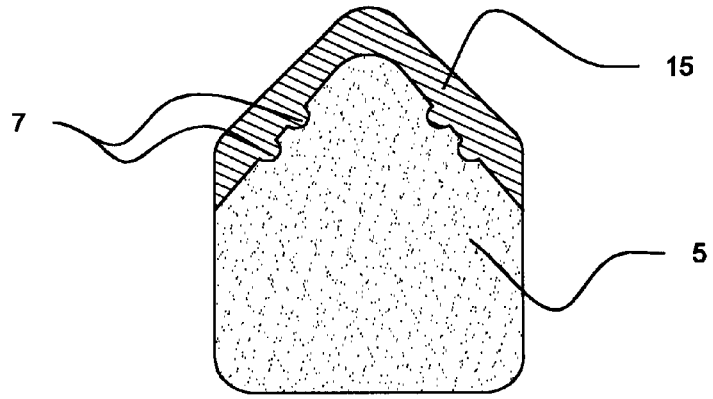
FIG. 19 is a cross-sectional view of a conical substrate of the present invention depicting one or more grooves or furrows along the inclined edge of the substrate.

FIG. 19. This is another embodiment of the present invention showing a conical cutting element having a substrate 5 comprising two circumscribing grooves 7 along the inclined edge. The superhard material 15 is bonded to the substrate by means of a high-pressure high-temperature sintering process known in the art.

Figure 20:
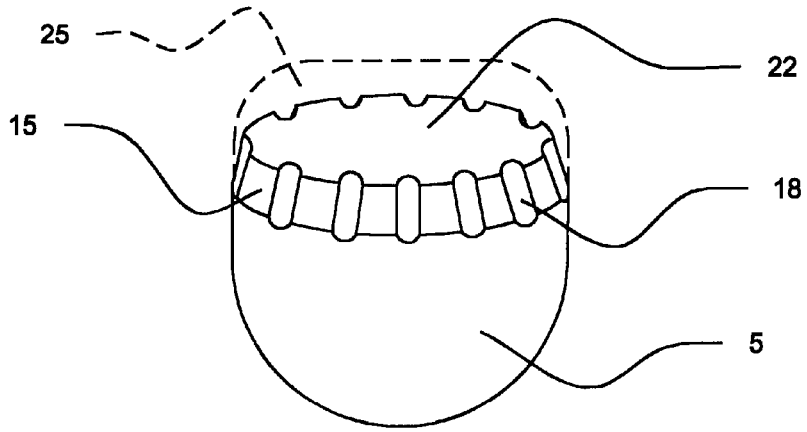
FIG. 20 is a cross-sectional view of a substrate of the present invention depicting a planar major interfacial surface having an inclined edge exhibiting flutes.

FIG. 20. This is another embodiment of the present invention depicting a substrate 5 having planar major interfacial surface 22 and an inclined edge 15. The inclined edge also comprises flutes 18, or rounded vertical grooves, that provide additional sub-lateral support to the cutting edge of the element and also provide additional surface area of attachment. The flutes may be economically preformed into the substrate or installed by means of modern machining methods such as grinding and EDM cutting. The superhard material 25 is bonded across the surface 22 and down the inclined edge 15 to provide a cutting element as depicted in the FIG. 18.

Figure 21:
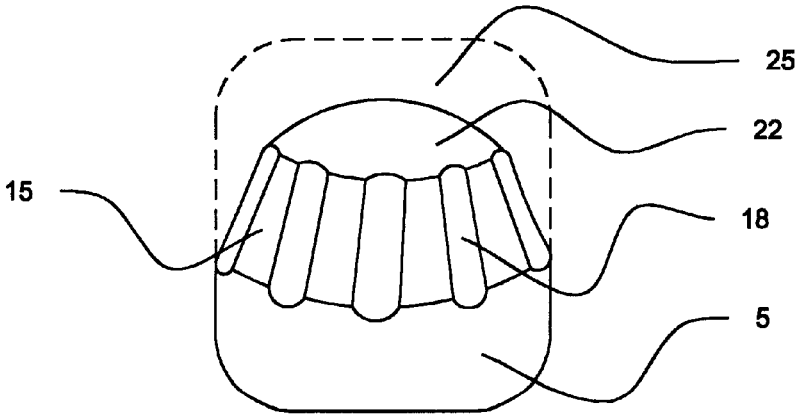
FIG. 21 is a cross-sectional view of a substrate of the present invention depicting a convex major interfacial surface having an inclined edge exhibiting flutes.

FIG. 21. This is another embodiment of the present invention depicting a substrate 5 having a convex major interfacial surface 22 and an inclined edge 15. The inclined edge also comprises flutes 18, or rounded vertical grooves, that provide additional sub-lateral support to the cutting surface of the element and also provide additional surface area of attachment. The flutes may be economically preformed into the substrate or installed by means of modern machining methods such as grinding and EDM cutting. The superhard material 25 is bonded across the surface 22 and down the inclined edge 15 to provide a cutting element as depicted in the FIG. 18 or a cutting element not shown having a hemispherical or domed profile.

Figure 22:
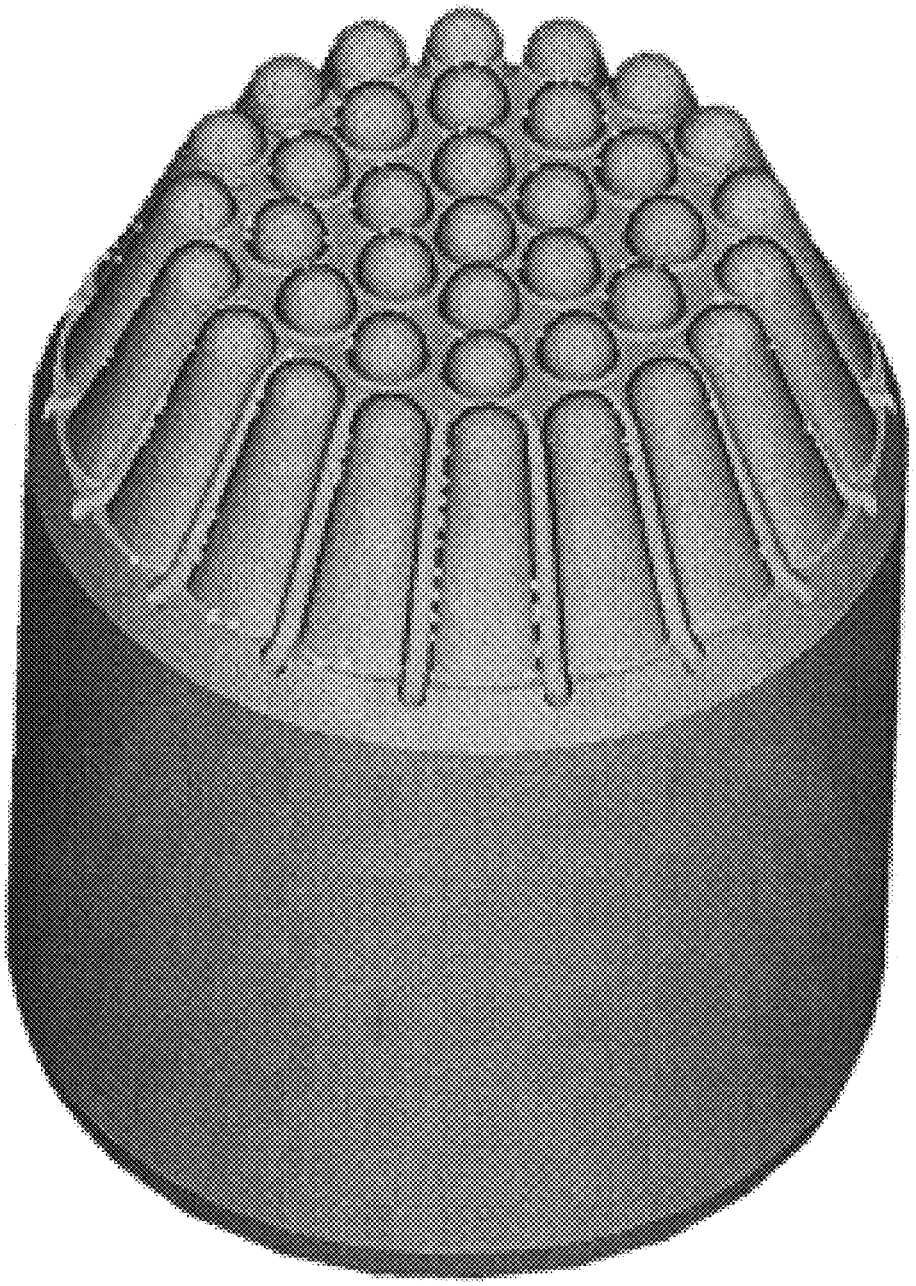
FIG. 22 is a perspective view of a substrate of the present invention exhibiting an inclined edge having flutes.

FIG. 22. This is another embodiment of a fluted substrate of the present invention. This embodiment features nodules along its major interfacial surface and at its inclined edge.

What is claimed:

1. A heel, gage, or cutting element, comprising:

(a) a cemented metal-carbide substrate, preferably of tungsten carbide, (b) the substrate having a major interfacial surface;

(c) the major interfacial surface comprising an inclined edge having one or more inclinations that are circumscribed by one or more furrows or grooves, or the inclined edge comprising flutes, (d) the major surface and inclined edge of said substrate are bonded to one or more layers of superhard materials by means of high temperature and high pressure in such a manner that the superhard materials extend below a plane of the major interfacing surface.

2. The heel, gage, or cutting element of claim 1 wherein said metal-carbide substrate has a cylindrical or conical cross section shape.

3. The heel, gage, or cutting element of claim 1 wherein another major surface of the superhard material is planar.

4. The heel, gage, or cutting element of claim 1 wherein the outer major surface of the superhard material is convex.

5. The heel, gage, or cutting element of claim 1 wherein the major interfacing surface of the metal-carbide substrate is planar.

6. The heel, gage, or cutting element of claim 1 wherein the major interfacing surface of the metal-carbide substrate is non-planar.

7. The heel, gage, or cutting element of claim 1 wherein the major interfacing surface of the metal-carbide substrate is convex.

8. The heel, gage, or cutting element of claim 1 wherein the metal-carbide substrate comprises a domed or hemispherical surface on the side opposite its superhard interface.

* * * * *